US005838107A

United States Patent [19]

Beunas et al.

[11] Patent Number: 5,838,107

[45] Date of Patent: Nov. 17, 1998

[54] MULTIPLE-BEAM ELECTRON TUBE WITH CAVITY/BEAM COUPLING VIA DRIFT TUBES HAVING FACING LIPS

[75] Inventors: Armel Beunas, Boulogne Billancourt; Georges Faillon, Meudon, both of France

[73] Assignee: Thomson Tubes Electroniques, Meudon la Foret, France

[21] Appl. No.: 686,719

[22] Filed: Jul. 26, 1996

[30] Foreign Application Priority Data

Jul. 28, 1995 [FR] France ..... 95 09226

[51] Int. Cl.[6] ..... H01J 25/10

[52] U.S. Cl. ..... 315/5.16; 315/5.51

[58] Field of Search ..... 315/5.14, 5.16, 315/5.29, 5.39, 5.51

[56] References Cited

U.S. PATENT DOCUMENTS

| | | | |
|---|---|---|---|
| 3,447,018 | 5/1969 | Schmidt | 315/5.29 |
| 3,775,635 | 11/1973 | Faillon et al. | 315/5.43 |
| 3,846,665 | 11/1974 | Firmain et al. | 315/5.43 |
| 4,173,744 | 11/1979 | Faillon et al. | 333/33 |
| 4,243,961 | 1/1981 | Faillon et al. | 333/233 |
| 4,401,918 | 8/1983 | Maschke | 315/5.34 |
| 4,591,799 | 5/1986 | Faillon et al. | 330/45 |
| 4,733,131 | 3/1988 | Tran et al. | 315/5.14 |
| 4,749,906 | 6/1988 | Tran et al. | 315/5 |
| 4,827,192 | 5/1989 | Tran et al. | 315/5.39 |
| 4,933,594 | 6/1990 | Faillon et al. | 313/153 |
| 5,043,630 | 8/1991 | Faillon et al. | 315/5 |
| 5,109,179 | 4/1992 | Faillon et al. | 313/153 |
| 5,225,739 | 7/1993 | Faillon et al. | 315/5.43 |
| 5,235,249 | 8/1993 | Mourier | 315/5.16 X |
| 5,239,235 | 8/1993 | Mourrer | 315/5.16 X |
| 5,494,470 | 2/1996 | Beunas et al. | 445/35 |

FOREIGN PATENT DOCUMENTS

| | | | |
|---|---|---|---|
| 0 440 529 | 8/1991 | European Pat. Off. . | |
| 881964 | 5/1942 | France . | |
| 1 534 445 | 8/1967 | France . | |
| 1293349 | 4/1969 | Germany | 315/5.16 |
| 582183 | 11/1946 | United Kingdom . | |

OTHER PUBLICATIONS

"RF Tubes For Space–Based Accelerators," A. S. Gilmour Jr. et al. IEEE Transactions On Electron Devices, vol. 38, No. 10, Oct. 1, 1991. pp. 2190–2204.

"A High Power CW Or Long Pulse Klystron: 500 kW at 3.7 GHz," A. Auberdiac et al. IEEE Et Al. Proceedings of the II Symposium Fusion Engineering, Nov. 18–22, 1985. pp. 1312–1315.

*Primary Examiner*—Benny T. Lee

*Attorney, Agent, or Firm*—Oblon, Spivak, McClelland, Maier & Neustadt, P.C.

[57] ABSTRACT

Disclosed is an multiple-beam electron tube built around an axis (Z). These electron beams go through at least one resonant cavity (10) coaxial with this axis (Z). The beams are contained on both sides of the cavity in drift tubes (3) that end in the cavity in lips (5'), facing each other in the cavity. The spacing between two facing lips is not constant. Application especially to multiple-beam klystrons with improved output.

12 Claims, 9 Drawing Sheets

MULTIPLE-BEAM ELECTRON TUBE WITH CAVITY/BEAM COUPLING VIA DRIFT TUBES HAVING FACING LIPS

BACKGROUND OF THE DESCRIPTION

1. Field of the Invention

The present invention relates to the field of multiple-beam cavity type electron tubes such as multiple-beam klystrons.

2. Description of the Prior Art

A multiple-beam klystron has several parallel longitudinal elementary electron beams produced by one or more guns. These beams go through a succession of resonant cavities. Two successive cavities are separated by drift tubes that contain the beams between the cavities. The drift tubes end in the cavities in lips, with two opposing lips defining an interaction space.

Increasing the number of beams makes it possible, as compared with a single-beam klystron of the same power, to reduce the high voltage, the total current used by the multiple-beam klystron being higher in exchange.

This reduction of high voltage has the advantages of simplifying and making the voltage supplies and signal modulator more reliable, reducing the risks of arcs in the gun and increasing the pulse widths. The length of the tube is thereby also reduced. The elementary beams generally have a lower perveance than that of the single-beam klystron of the same power, thus making it possible to obtain higher interaction outputs, with the space charge effects being reduced.

Finally, since the cavities are charged with a greater total current (the total perveance being higher), the passband of the multiple-beam klystron is wider.

However, these electron tubes also have drawbacks.

A single-beam klystron has a symmetry of revolution about an axis which is the axis of the tube. The cavities and the focusing unit are mounted coaxially about this axis. The electron beam is centered on this axis. In the cavities, the longitudinal electrical field between the lips has a symmetry of revolution about the axis of the tube. The mode of oscillation of the cavity is generally its fundamental mode.

This symmetry of revolution about an axis which is the axis of the tube is also found in a multiple-beam klystron. The cavities and the focusing unit are mounted coaxially about this axis, but the electron beams are no longer centered on the axis of the tube. They are off axis. They are arranged along the generatrices of one or more cylinders that are coaxial with the axis of the tube. In the cavities, the longitudinal electrical field is always symmetrical and has a shape generated by revolution above the axis of the tube for the fundamental mode and the higher modes whose first index value is zero, for example $TM_{Omp}$, but between the lips of the drift tubes, the electrical field does not have any symmetry of revolution about the axis of each of the beams. Consequently, the electrons do not get bunched homogeneously along the azimuth. This leads to a deterioration of the electron bunching mechanisms in the drift tubes as well as in risks of interaction. The disturbance of the bunching of the electrons can be amplified from one cavity to the next one to become big enough in the last cavity or output cavity to lead to a substantial reduction of the interaction output.

The present invention is aimed at obtaining the homogeneity of the cavity/beam coupling so as to retain an ideal bunching of the electrons in a drift tube emerging from a cavity and prevent a deflection of a part of the electrons. This homogenization is obtained by setting up a longitudinal electrical field profile with respect to the beams that possesses, approximately, a symmetry of revolution.

SUMMARY OF THE INVENTION

To achieve this goal, the present invention proposes an electron tube comprising several electron beams substantially parallel to an axis, these beams going through at least one resonant cavity coaxial with this axis. The beams are contained on both sides of the cavity in drift tubes that end in the cavity in lips, two facing lips defining an interaction space. The spacing between two facing mouths is not constant in azimuth. This spacing is the maximum in a zone of the interaction space close to the axis of the tube and it is the minimum in a zone of the interaction space that is distant from the axis of the tube.

The lips of the drift tubes are preferably bevelled on at least a part of their periphery. The bevel may have a plane profile or an incurvated profile.

When the bevel is partial, the other part of the periphery of the lip is preferably normal to the axis of the tube.

To improve the behavior under high frequency power, the edge of these lips may be rounded throughout their periphery.

The ratio between the minimum spacing and the maximum spacing is greater than or equal to 0.6.

It is preferable that the interaction space should be symmetrical with respect to a median plane of the cavity, this plane remaining substantially normal to the axis of the tube.

The electron beams are located on generatrices of one or more cylinders coaxial to the axis of the tube.

In order to increase the number of electron beams, it may be useful to place an additional electron beam centered on the axis of the tube. The spacing between two facing lips associated with this beam will be chosen to be greater than or equal to the maximum spacing of the lips associated with the other electron beams.

In certain configurations, the drift tubes protrude into the cavity. To facilitate the making of the lips, it may be useful for the cavity to have at least one recessed part and, within the cavity, for the lips to be flush with this recessed part.

BRIEF DESCRIPTION OF THE DRAWINGS

Other features and advantages of the invention shall appear from the following detailed description made with reference to the appended drawings, of which.

DETAILED DESCRIPTION OF THE INVENTION

Figure 1A:
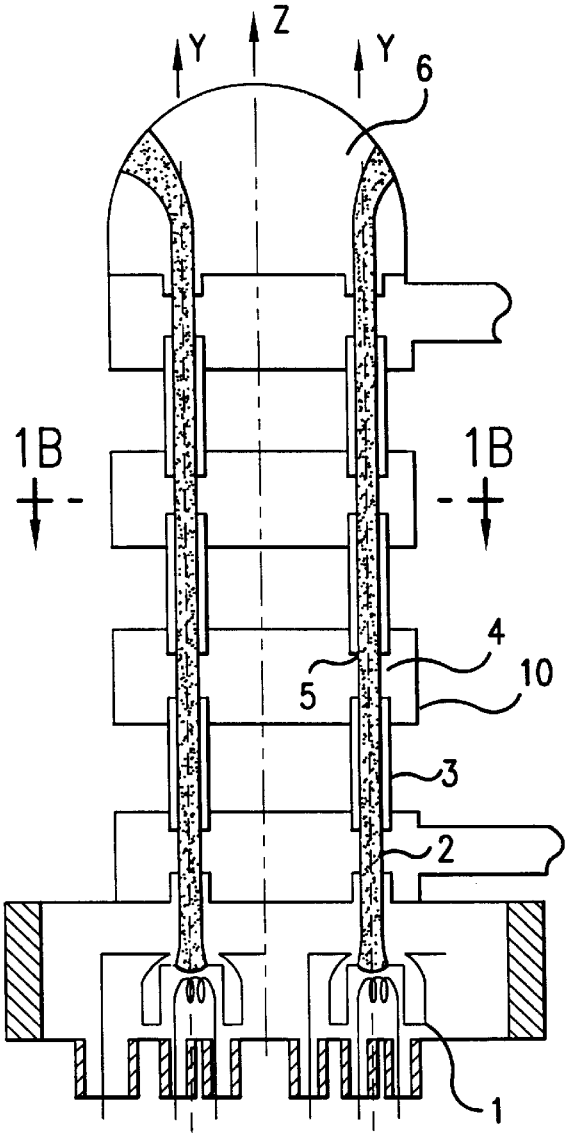
FIG.1A PRIOR ART
FIGS. 1*a*, 1*b* respectively show a longitudinal sectional view and a cross-sectional view (section a-a') of a prior art electron tube where the axis r in FIG. 1*b* indicates a radial direction going through the center of the electron tube.
Figure 1B:
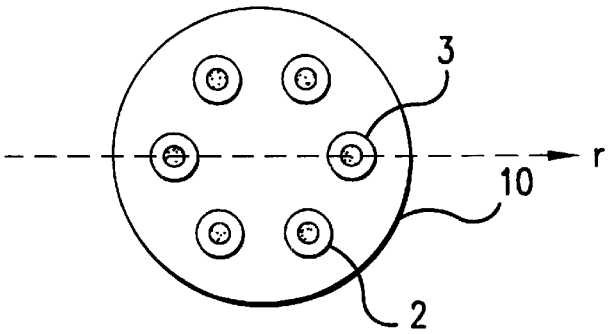
FIG.1B PRIOR ART

The multiple-beam electron tube shown in FIGS. 1*a*, 1*b* is built around an axis Z (see FIG. 1*a*). It has Six substantially parallel electron beams 2 with an axis Y (see FIG. 1*a*). The axes Y are the generatrices of a cylinder with an axis Z. Each beam 2 is produced by an electron gun 1 (see FIG. 1*a*). The electron beams 2 go through a succession of resonant cavities 10. Between the cavities 10, the electron beams 2 go through drift tubes 3 with an axis Y that leads into the cavities 10. The cavities 10 are separated by the drift tubes 2. At the end of their journey, the electrons are gathered in a collector 6 (see FIG. 1*a*). A focusing device (not shown) surrounds the cavities 10. The cavities 10 have a general shape of a cylinder with an axis Z. They are closed at both their ends by walls perpendicular to the beams 2.

Figure 1C:
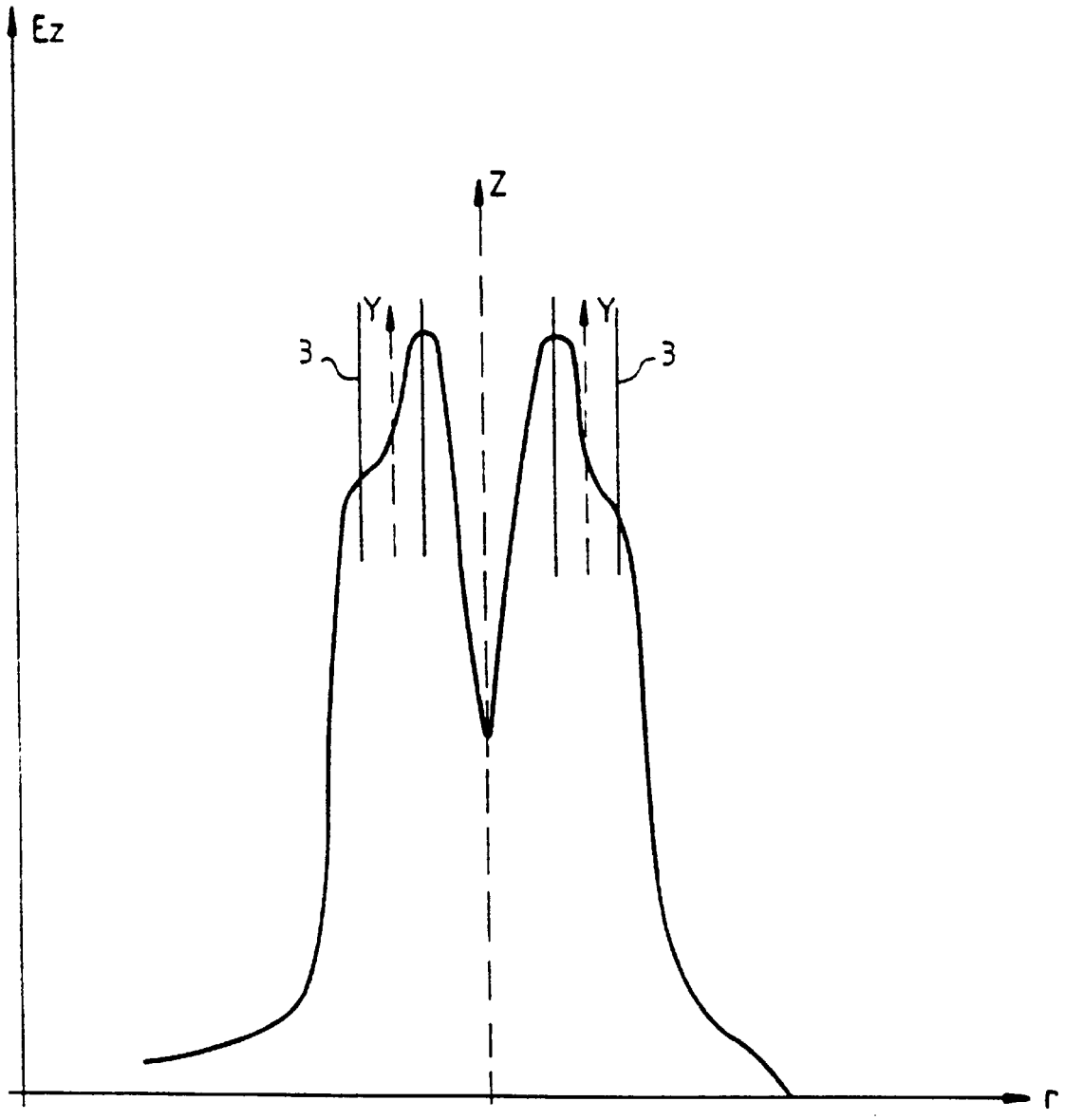
FIG. 1c PRIOR ART
FIG. 1*c* shows the variations of the longitudinal electrical field Ez in a median plane of the cavity of the tube of FIGS. 1*a*, 1*b* as a function of a radius r of this cavity going through the center of two diametrically opposite drift tubes.

Within the cavities 10, the ends 5 (see FIG. 1*a*) or lips of two drift tubes 3 containing one and the same beam 2 face each other by demarcating an interaction space 4 (see FIG. 1*a*). In this FIG. 1*a*, the lips 5 are in planes that are normal to the axis Z. The spacing between two facing lips 5 is constant about the axis Y associated with the lips 5. In FIG. 1*c*, it can be seen that the longitudinal electrical field Ez has a symmetry with respect to the axis Z of the tube and that no symmetry exists with respect to the axes Y. The drift tubes are symbolized by unbroken lines. This electrical field Ez has a peak located between each axis Y and the axis Z of the tube. This dissymmetry makes the cavity/beam coupling inhomogeneous, thus disturbing the bunching of the electrons in the drift tubes. The variation of the electrical field Ez goes up to about 16% in the interaction space.

Figure 2A:
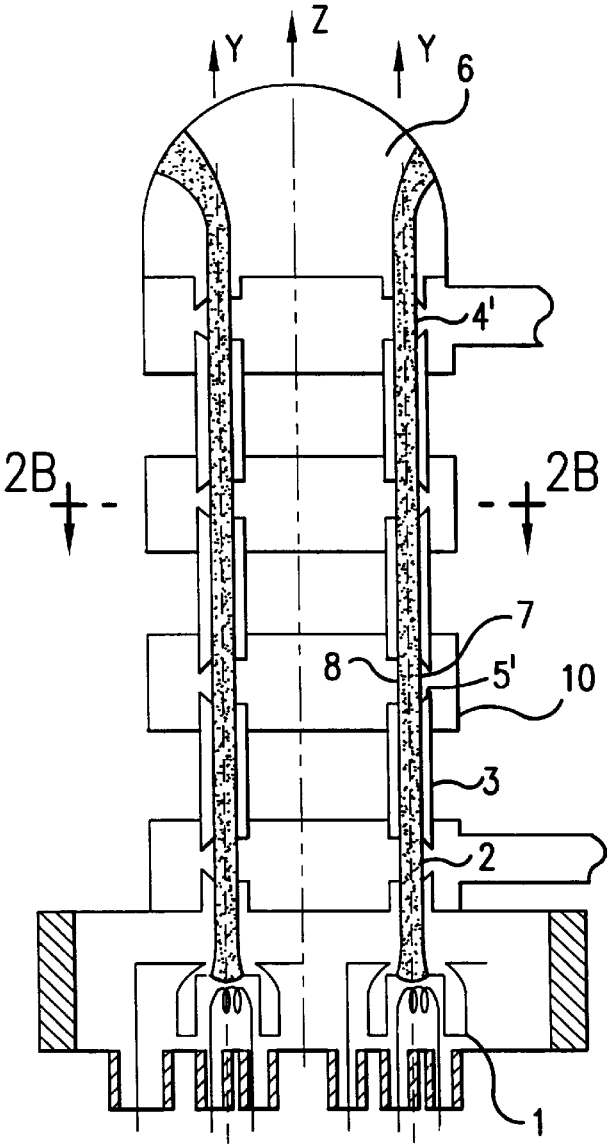
FIGS. 2*a*, 2*b* respectively show a longitudinal view and a cross-sectional view (section a-a') of an electron tube according to the invention where the axis r in FIG. 2*b* indicates a radial direction going through the center of the electron tube.
Figure 2B:
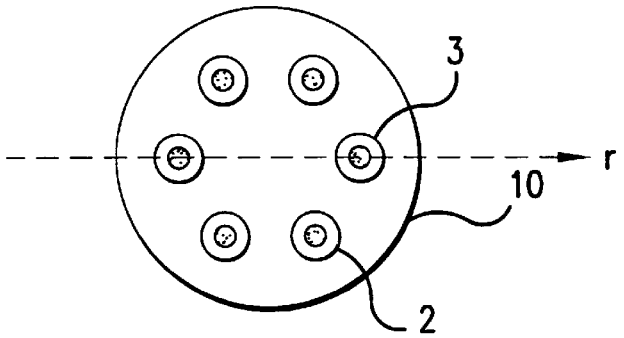

FIGS. 2*a*, 2*b* give a longitudinal and cross-sectional view of an exemplary electron tube according to the invention. It will be noted that the invention relates chiefly to multiple-beam tubes whose cavities resonate in the fundamental TM mode. This tube is comparable to that of FIG. 1*a*, 1*b*. The following are seen again with the same references: the guns 1 (see FIG. 2*a*), the six electron beams 2 with an axis Y (see FIG. 2*a*), the cavities 10, the collector 6 (see FIG. 2*a*) and the drift tubes 3 with an axis Y. The difference between these two tubes lies in the lips 5' (see FIG. 2*a*) of the drift tubes and the interaction space 4' (see FIG. 2*a*).

The spacing between two facing lips 5' is no longer constant about the axis Y associated with these lips. It varies according to the azimuth. The azimuth corresponds to an angular position about an axis Y. It is represented and specified in FIG. 3*b*. This spacing is the maximum in a zone 8 (see FIG. 2*a*) of the interaction space 4' close to the axis Z (see FIG. 2*a*) of the tube and is the minimum in a zone 7 (see FIG. 2*a*) of the interaction space 4' at a distance from the axis Z of the tube.

Figure 4A:
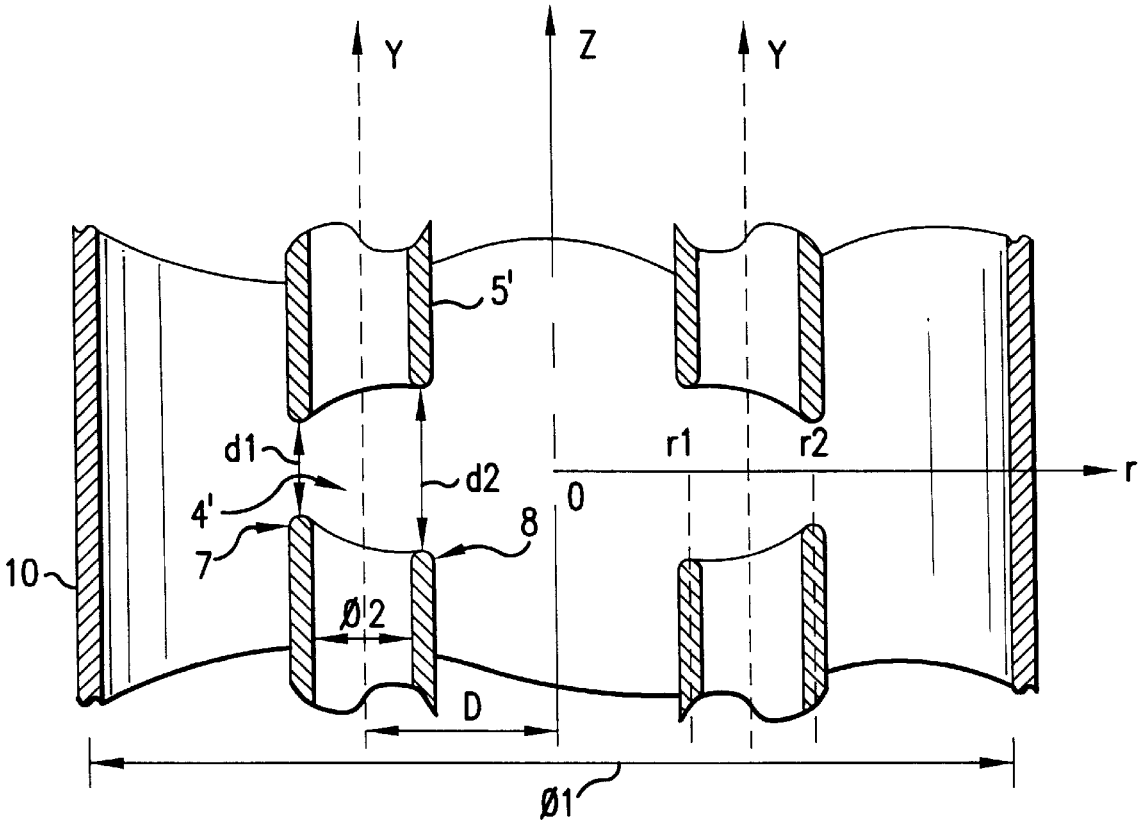
FIG. 4*a* shows a longitudinal sectional view of the details of a cavity of another exemplary tube according to the invention.

In the example shown, the lips 5' have a first bevelled portion that is distant from the axis Z and a second portion, substantially perpendicular to the axis Z of the tube, that is close to this axis Z. The bevel may have a plane profile as shown in FIG. 2*a* or an incurvated profile as shown in FIG. 4*a*. In the example described, the two portions are semi-peripheries. Other configurations are possible. In particular, the first portion and the second portion may be inverted.

Preferably, the interaction space 4' is symmetrical with respect to a median plane of the cavity 10 and substantially normal to the axis Z of the tube. When there is no correction of the lips, in the zone 7 that is distant from the axis Z, the longitudinal electrical field is weaker than in the zone 8 close to the axis Z of the tube as illustrated by the curve of FIG. 1*c*.

Figure 2C:
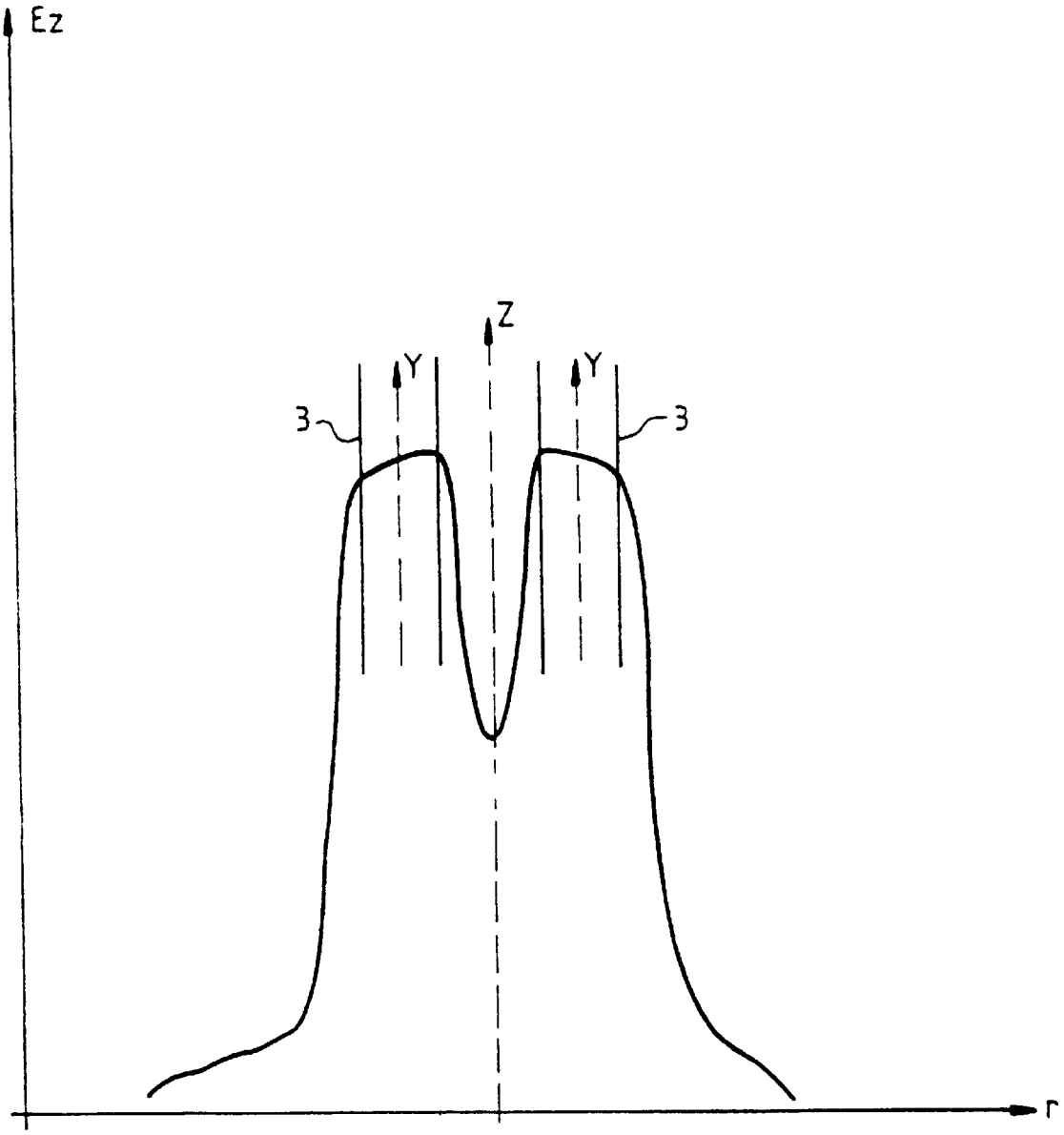
FIG. 2*c* shows the variations of the longitudinal electrical field Ez in a median plane of a cavity of the tubes of FIGS. 2*a*, 2*b* as a function of a radius r of this cavity going through the center of two diametrically opposite drift tubes.

The graph of FIG. 2*c* shows that the longitudinal electrical field Ez approximately has a symmetry about the axes Y of the electron beams. In the example shown, the longitudinal electrical field Ez is even substantially constant in the sectional plane of FIG. 2*b* at the electron beams. The variation of the electrical field is in the range of 3%.

Figure 3A:
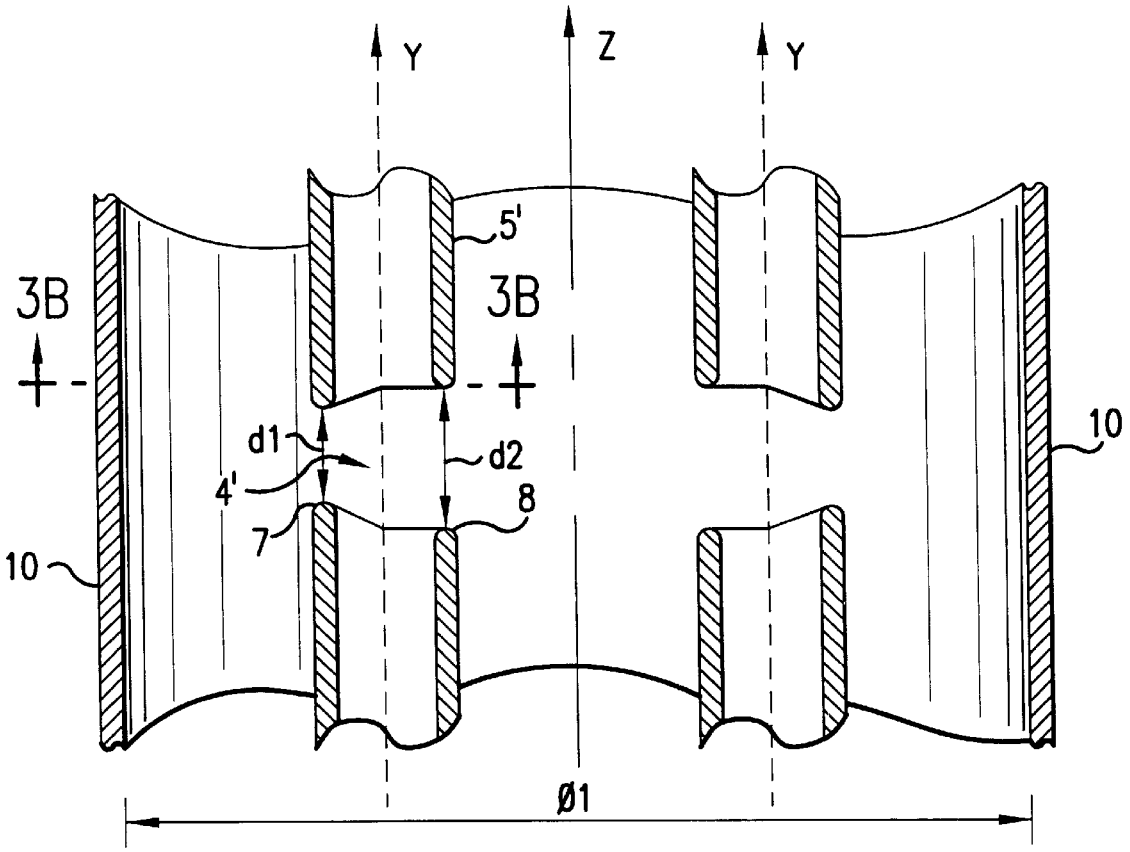
FIGS. 3*a*, 3*b* respectively show a longitudinal view and a cross-sectional view (section b-b') of the details of a cavity of a tube according to the invention.
Figure 3B:
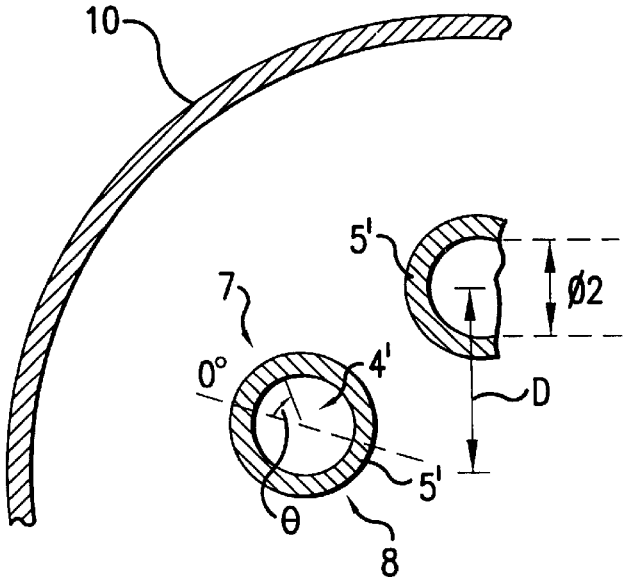

FIGS. 3*a* and 3*b* provide an exemplary illustration of a cavity of an electron tube according to the invention, making it possible to obtain an improved cavity/beam coupling as compared with the prior art. The lips 5' are configured as in FIG. 2*a*.

The azimuth $\Theta=0$ (see FIG. 3*b*) corresponds to the angular position furthest away from the axis Z (see FIG. 3*a*) of the tube, while the azimuth $\Theta=180°$ corresponds to the angular position closest to the axis Z of the tube.

In the case of FIG. 1*a*, the variation of the electrical field Ez along the azimuth $\Theta$ reaches 16%. In the case of FIG. 3*a*, the bevelling of the lips enables the variation of the electrical field Ez to be reduced to 3%.

The bevelling operation thus makes it possible to recover an almost constant interaction despite the azimuth variations of the distance between lips and the electrical field.

These measurements correspond to tubes with six electron beams having the following characteristics:

Standard multiple-beam tube:
- diameter of the cavity $\phi$1=350 mm (see FIG. 3*a*)
- offset of the beams D=50 mm (see FIG. 3*b*)
- spacing of the lips d=16 mm (see FIG. 3*a*, where d=d1 and d2)
- internal diameter of the drift tubes $\phi$2=17 mm (see FIG. 3*b*).

Tube according to the invention:
- diameter of the cavity $\phi$1=350 mm (see FIG. 3*a*)
- offset of the beams D=50 mm (see FIG. 3*b*)
- maximum spacing of the lips d2=18 mm (see FIG. 3*a*)
- minimum spacing of the lips d1=16 mm (see FIG. 3*a*)
- internal diameter of the drift tubes $\phi$2=17 mm (see FIG. 3*b*).

The configuration of the lips 5' is not limited to that shown in FIGS. 2*a*, 3*a*.

FIG. 4*a* gives a partial longitudinal sectional view of a cavity of a variant of an electron tube according to the invention. Now, the lips are bevelled throughout the periphery and the bevel has an incurvated profile. To improve the behavior of the lips under high frequency power, the edge of the lips is rounded throughout their periphery.

Figure 4B:
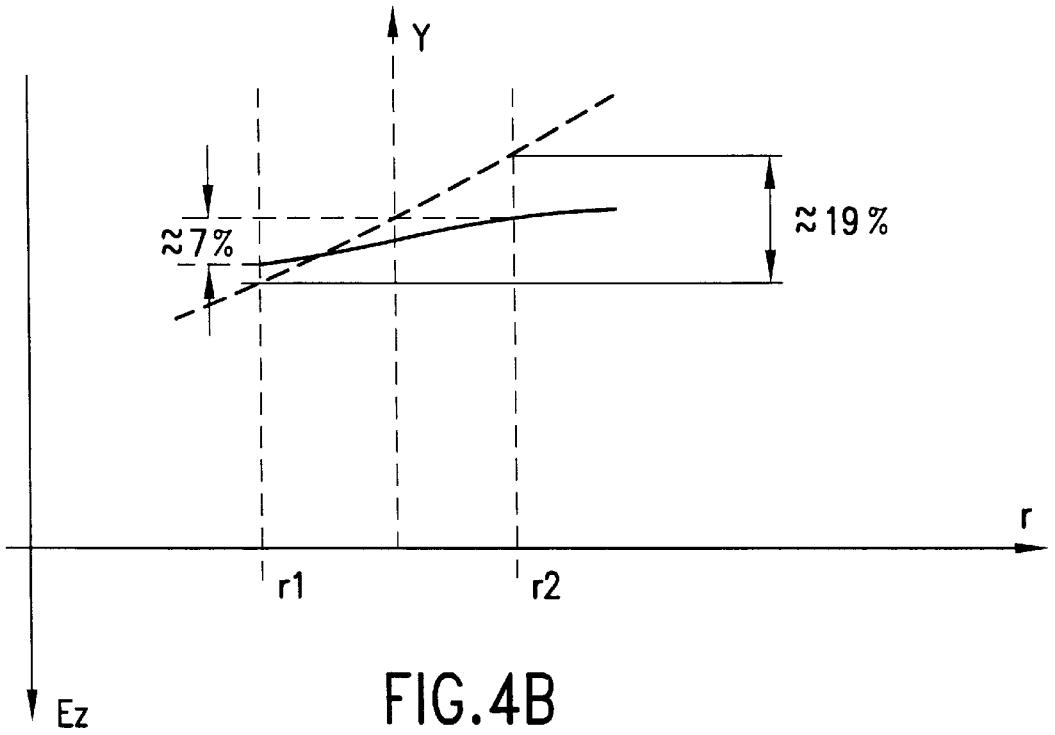
FIG. 4*b* illustrates the variations of the longitudinal electrical field Ez in a median plane of the cavity of FIG. 4*a* as a function of a radius r of this cavity going through the center of a drift tube.

FIG. 4*b* gives a view, in a median plane of a cavity, of the variation of the longitudinal electrical field Ez along a diameter of a drift tube going through the axis Z of electron the tube. One of the curves (in dashes) corresponds to the case of a known tube like that of FIG. 1*a* and the other (in unbroken lines) corresponds to the case of a tube according to the invention having a cavity such as that of FIG. 4*a*. In the interaction space 4', the longitudinal electrical field Ez varies by about 19% for the known tube while this variation is less than 7% for the tube according to the invention. The abscissa positions r1 and r2 are those of the two diametrically opposite edges of the drift tube 3. In FIG. 4*a*, the abscissa position O is on the axis Z of the tube. These measurements correspond to six-beam tubes having the following characteristics:

Standard multiple-beam tube:
- diameter of the cavity $\phi$1=125 mm
- offset of the beams D=50 mm
- spacing of the lips d=24 mm
- internal diameter of the drift tubes $\phi$2=16 mm.

Tube according to the invention:
- diameter of the cavity $\phi$1=125 mm
- offset of the beams D=50 mm
- maximum spacing of the lips d2=24 mm
- minimum spacing of the lips d1=19.5 mm
- internal diameter of the drift tubes $\phi$2=16 mm.

In the examples shown in FIGS. 3*a*, 3*b*, 4*a*, the ratio between the minimum spacing d1 and the maximum spacing d2 is greater than or equal to 0.6. All other configurations of lips in which the spacing between two opposing lips varies in such a way that this spacing is the minimum in a portion of the lips distant from the axis of the tube and the maximum in a portion of the lips close to the axis of the tube in order that the longitudinal electrical field may remain substantially constant along the azimuth, form part of the invention.

Figure 5B:
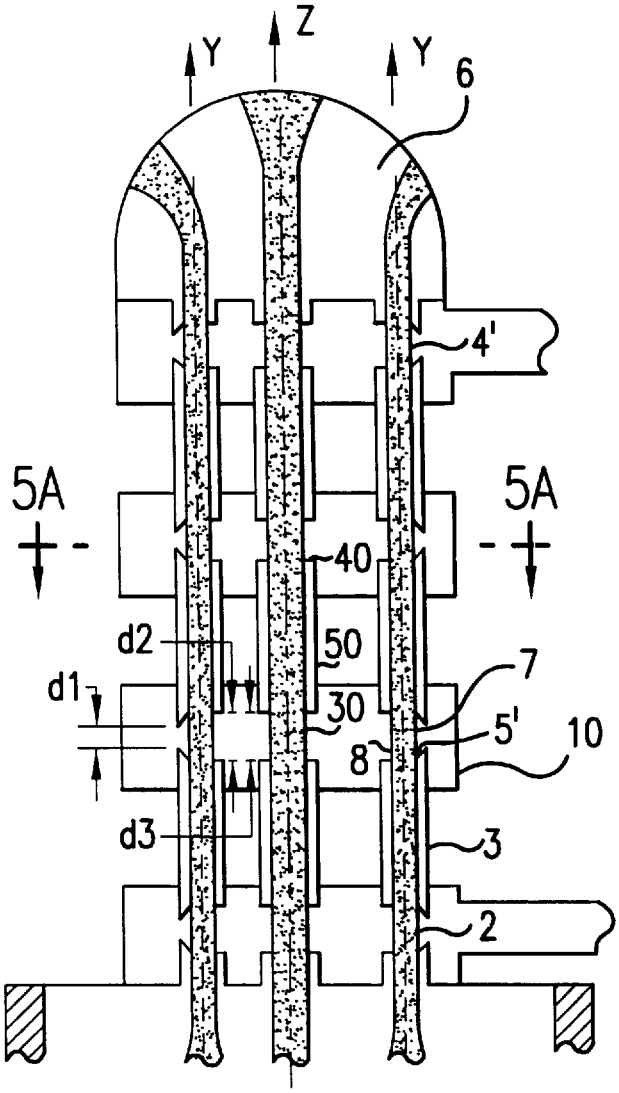
FIGS. 5*a*, 5*b* respectively show a longitudinal view and a cross-sectional view (Section a-a') of yet another variant of the tube according to the invention with seven electron beams where the axis r in FIG. 5*a* indicates a radial direction going through the center of the electron tube.
Figure 5A:
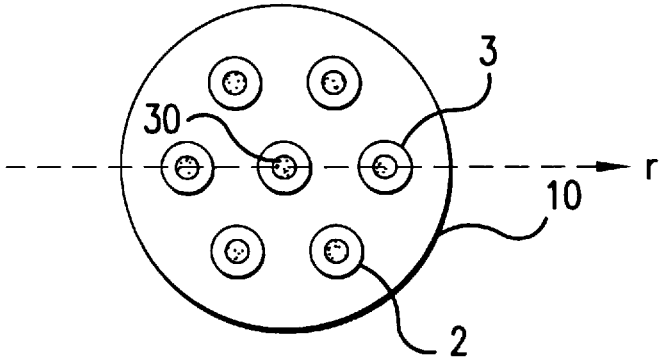

In certain multiple-beam klystrons, in order to increase the number of beams, it may become necessary to position an additional electron beam along the axis Z of the tube. This is what is shown in FIGS. 5*a* and 5*b*. The tube shown can be compared with that of FIGS. 2*a* and 2*b* at the lips 5' (see FIG. 5*b*) of the drift tubes 3 associated with the offset electron beams 2. It is preferable that the lips 40 (see FIG. 5*b*) of the drift tubes 50 (see FIG. 5*b*) containing this additional electron beam 30 (see FIG. 5*a*, 5*b*) should be 35 separated by a spacing d3 (see FIG. 5*b*) greater than or equal to the maximum spacing d2 (see FIG. 5*b*) of the lips 5' of the other drift tubes 50. The additional electron beam 30 is identical to the other offset electron beams 2. The drift tubes 3, 50 all have substantially the same diameter.

Figure 5C:
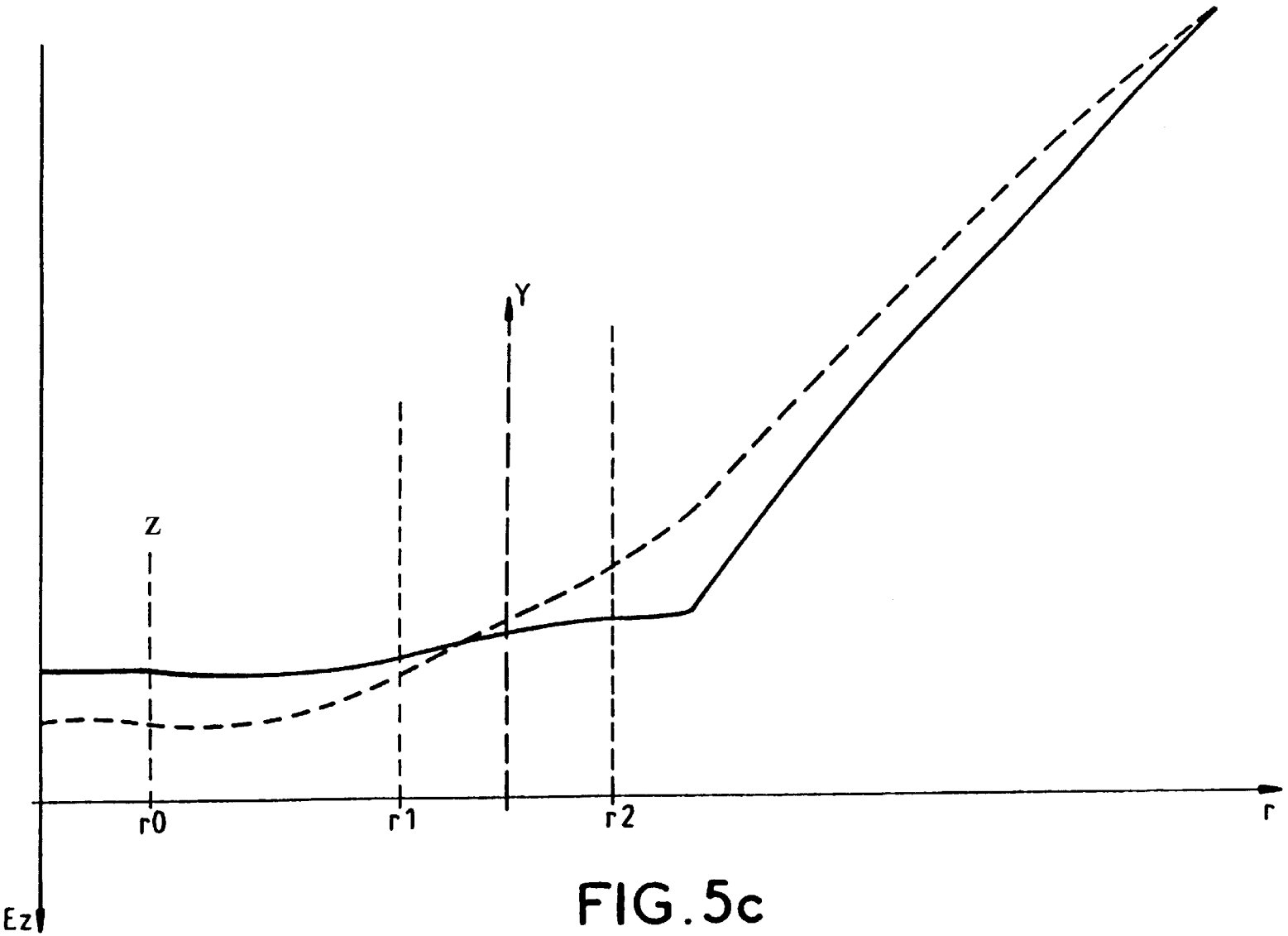
FIG. 5*c* illustrates the variations of the longitudinal electrical field Ez in a median plane of the cavity of FIGS. 5*a*, 5*b* as a function of a radius r of this cavity going through the center of a drift tube offset with respect to the axis of the tube.

FIG. 5*c*, which can be compared with FIG. 4*b* gives a view, in a median plane of the cavity, of the variations of the longitudinal electrical field Ez along a radius of the cavity passing through a diameter of a drift tube. The curve in dashes corresponds to the case of a standard multiple-beam klystron with seven electron beams, including one central beam and lips without correction. The curve shown in an unbroken line corresponds to the case of a klystron of FIGS. 5*a*, 5*b*. The X-axis value r0 is located on the edge of a lip 40 (see FIG. 5*b*) associated with the additional beam. The spacing d3 (see FIG. 5*b*) is equal to the spacing d2 (see FIG. 5*b*). The longitudinal electrical field Ez, instead of having a minimum at the level of the axis Z (see FIG. 5*b*) of the tube, remains substantially constant in the vicinity of the axis Z of the tube.

Figure 6:
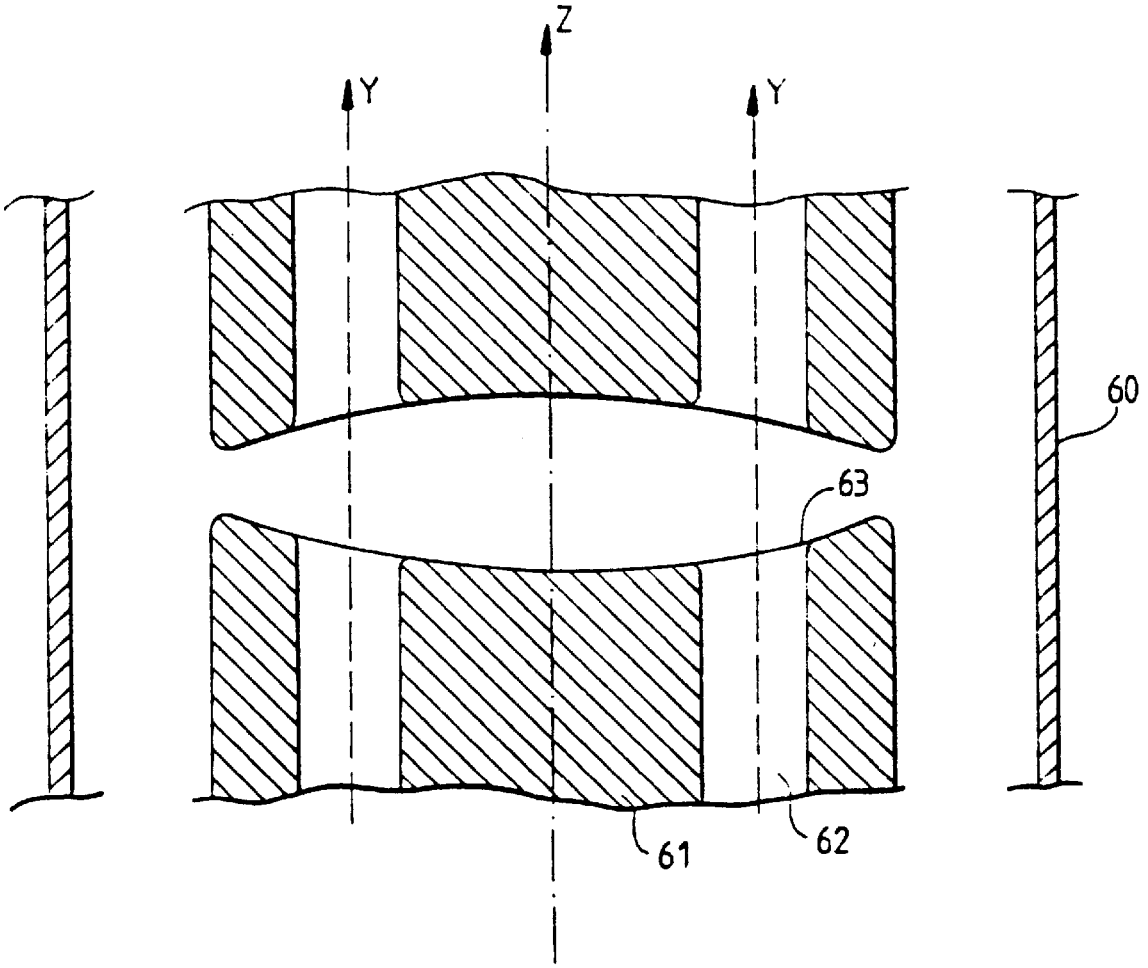
FIG. 6 shows a longitudinal sectional view of the details of a cavity of another exemplary tube according to the invention.

Reference is made to FIG. 6. The cavity 60 shown now has at least one recessed part 61 that supports the drift tube 62. Within the cavity 60, the lips 63 of these drift tubes 62 are flush with the recessed part 61. In the FIG. 6, the recessed part is incurvated. Its configuration contributes to the correction of the lips 63. This variant is of a type that makes it easy to obtain lips.

What is claimed is:

1. An electron tube comprising several electron beams substantially parallel to an axis Z, the electron beams going through at least one resonant cavity coaxial with and aligned along the Z axis and being contained in a plurality of drift tubes that end inside respective ones of said at least one cavities, said plurality of drift tubes inside said respective cavities having respective lips that face each other and that define an interaction space wherein, in order to homogenize the respective couplings between the cavity and the beams, a spacing between two facing lips varies in azimuth and is the maximum spacing in a zone of the interaction space close to the Z axis of the electron tube and is the minimum spacing in a zone of the interaction space that is distant from the Z axis of the electron tube.

2. An electron tube according to claim 1, wherein the respective lips of the corresponding drift tubes are bevelled on at least a part of a periphery thereof.

3. An electron tube according to claim 2, wherein the respective lips have another part of the periphery which is not beveled and is normal to the axis of the tube.

4. An electron tube according to claim 2, wherein the bevel has a plane profile.

5. An electron tube according to claim 2, wherein the bevel has an incurvated profile.

6. An electron beam according to claim 1, wherein the electron beams are located on generatrices of said at least one resonant cavities coaxial to the Z axis of the electron tube, wherein the cavities are cylindrical.

7. An electron tube according to claim 1, wherein the interaction space is symmetrical with respect to a median plane of the cavity, the plane being substantially normal to the axis of the tube.

8. An electron tube according to claim 1, wherein the ratio between the minimum spacing and the maximum spacing between the corresponding facing lips of each drift tube is greater than or equal to 0.6.

9. An electron tube according to claim 8, comprising an additional electron beam having a plurality of corresponding drift tubes associated with said additional beam, each said corresponding drift tube having corresponding lips, said additional beam being aligned along the Z axis of the electron tube, and the spacing between two facing lips associated with the plurality of drift tubes associated with said additional beam being greater than or equal to the maximum spacing between the corresponding facing lips of each drift tube associated with the other electron beams.

10. An electron tube according to claim 1, wherein the edge of the respective lips is rounded.

11. An electron tube according to claim 1, wherein the drift tubes protrude into the interior of the cavity.

12. An electron tube according to claim 1, wherein the respective lips are flush with a recessed part of the cavity.

* * * * *